US005582731A

United States Patent [19]

Gianfranco

[11] Patent Number: 5,582,731

[45] Date of Patent: Dec. 10, 1996

[54] DISPOSABLE FILTER FOR PREPARATION OF HOT BREWED BEVERAGE

[75] Inventor: Zanarini Gianfranco, Ozzano Emilia, Italy

[73] Assignee: M.T.R. S.r.l., Bologna, Italy

[21] Appl. No.: 536,347

[22] Filed: Sep. 29, 1995

[51] Int. Cl.[6] ..... B01D 29/085

[52] U.S. Cl. ..... 210/477; 210/481; 210/482; 426/77; 206/0.5

[58] Field of Search ..... 426/77, 78, 84; 99/295, 304, 323; 210/477, 481, 482; 206/0.5

[56] References Cited

U.S. PATENT DOCUMENTS

| | | | |
|---|---|---|---|
| 4,290,521 | 9/1981 | Mitchell | 426/77 |
| 4,584,101 | 4/1986 | Kataoka | 210/474 |
| 4,981,588 | 1/1991 | Poulallion | 426/77 |
| 5,059,325 | 10/1991 | Iida | 210/474 |

FOREIGN PATENT DOCUMENTS

| | | | |
|---|---|---|---|
| 186867 | 7/1986 | European Pat. Off. | 426/77 |
| 7603016 | 5/1977 | Netherlands | 426/77 |

*Primary Examiner*—W. L. Walker
*Attorney, Agent, or Firm*—McAulay Fisher Nissen Goldberg & Kiel

[57] ABSTRACT

A disposable filter bag for preparation of hot brewed beverages, particularly for the preparation of American coffee, comprises a double layer of water permeable paper material in which a chamber is delimited by weak weldings with a batch of ground coffee contained therein. The filter bag features wings foldable inwards over the chamber for reduction of the package size. To use the filter bag the wings are opened and the upper edges are separated so as to allow the weak weldings to be peeled off for complete opening of the filter bag inside a basket.

1 Claim, 2 Drawing Sheets

DISPOSABLE FILTER FOR PREPARATION OF HOT BREWED BEVERAGE

BACKGROUND OF THE INVENTION

The present invention relates to manufacturing of a filter bag containing a premeasured batch of vegetable substances for preparation of a brewed beverage, especially for preparation of coffee.

DESCRIPTION OF THE PRIOR ART

It is known to prepare brewed beverages from vegetable substances which have been previously dried or roasted and ground.

The ground substances, mainly aromatic substances, essential oils, and, sometimes, tonic, exciting or tranquillising substances are brewed, for some time, in a liquid, to which they pass their active principles, and, afterwards, they are separated from the said liquid by decantation or filtration.

The beverage brewing can be hot or cold, depending on the temperature in which the process is carried out.

Cold beverages are usually brewed for days or even months and almost always in ethyl alcohol, while hot beverages are prepared in few minutes and almost always with drinkable water.

Different methods and apparatuses have been used for the preparation of brewed beverages, according to the substance and the quantity of beverage as well a the time necessary for preparation.

For instance, the beverage known and appreciated nearly all over the world as aromatic and moderately exciting drink obtained by roasting and grinding of coffee berries, is prepared in many different methods and with various results.

The best known are: Turkish, Italian and American coffee. The Turkish coffee is prepared by putting some ground coffee inside a vessel, pouring therein a sufficient quantity of boiling water and leaving the whole for some minutes.

Afterwards, the ready beverage can be poured into a cup and drunk as soon as the greater number of coffee powder has settled on the bottom of the cup.

The Italian coffee is usually prepared by putting a proper quantity of ground coffee in a metal container that acts also as a filter, and then, by slow passing therethrough water heated in an adjacent boiler (Neapolitan coffee) or a mixture of water and pressurised water steam (espresso coffee).

The American coffee is drunk mainly in central-northern Europe and in Anglo-Saxon countries. It is prepared by making very hot water flow, slowly and continuously, through ground coffee contained in a filter bag made of porous paper of suitable type.

Machines currently used for the house preparation of American coffee usually consist of: a reservoir for feeding cold water; a properly shaped metallic pipe, connected at one end with the bottom of the feeding reservoir and having the other end free, open and turned downward; a removable collecting container having its mouth positioned under the free end of the pipe, so as to collect the beverage; a tapered basket, having its narrower end flattened and open at the bottom, and in touching relation with the collecting container mouth, covering it. The larger end of the basket is fully open and positioned just beneath the free end of the metallic pipe.

The pipe includes a first section that is vertical, a second section that is horizontal and finally, a third section that is also vertical and extends downwards. The lower part of the first vertical section is surrounded by a spiral electric heater.

To prepare coffee by means of such machine, a filter made of water permeable paper material, having roughly the shape of the basket, is introduced in the basket, then a suitable charge of ground coffee is poured in the filter and the electric heater is operated.

Water coming from the fixed reservoir flows through the metallic pipe and is heated and partially vaporised in the section surrounded by the heater.

Then, because of the thrust exerted by the steam, the heated water goes up through the vertical section of the pipe and goes out through the open end thus dropping on the coffee.

The dropped water is retained by the filter and touches the coffee for a time long enough to obtain the brewed beverage, and then reaches the bottom of the filter and falls into the collecting container.

While being used, the filter takes a tapered shape similar to the shape of the basket. The narrow end of the filter, that is closed, is located at the bottom while the larger end is fully open.

The filter is usually obtained from a sheet material that is overfolded and sealed along the side edges.

When it is packed, the filter takes a flat trapezoidal shape and to be used it must opened, separating the upper edges from each other.

Using this kind of filters brings about several problems, mainly due to the necessity of manual handling filters and ground coffee separately each time.

First of all, opening the filter and manually measuring the batch of coffee require some time, and furthermore, part of the ground coffee may remain in the space between the filter and the basket possibly falling into the collecting container. Lastly, usually coffee is bought already ground, or it is ground in an amount for several charges.

In both cases, the ground coffee remains for a long time exposed to air and environment moisture, thus undergoing transformation that changes the characteristics of the coffee and gives an unpleasant taste to the brewed beverage.

To solve the above mentioned problems, a filter already containing a premeasured batch of ground coffee has been proposed, that allows for a practical and efficient preparation of American coffee.

The disposable filter bag for preparation of a hot brewed beverage, particularly American coffee, includes two superimposed sheets of water permeable material having the form of a truncated circular sector, and joined to each other along a lower straight edge, a right side and a left side, as well as along an upper weak heat seam line forming the upper side of a closed chamber filled, before sealing, with a premeasured batch of a vegetable substance properly prepared.

The filter bag can be manually opened by pulling upper strips made in the same filter bag and delimited by the upper heat seam line and an upper arched edge of the filter. The filter bag is then inserted into the basket of the brewing device.

The known filters, however, have a trapezoidal shape that is not suitable for easy and convenient packaging. Also the appearance of the filter bag when packaged is not fine and the package is quite odd and leads to a waste of space.

SUMMARY OF THE INVENTION

The object of the present invention is to propose a filter bag or pouch that, starting from the shape of the already known filter bag, is lastly obtained with a regular or rectangular shape, so that stacks of the new filter bags can be easily handled by automatic devices, and packaged into regular boxes, thus saving space and material.

BRIEF DESCRIPTION OF THE DRAWINGS

How the foregoing object and advantages are obtained will be clear from the following description referring to the accompanying drawings in which.

DESCRIPTION OF THE PREFERRED EMBODIMENT

Figure 1:
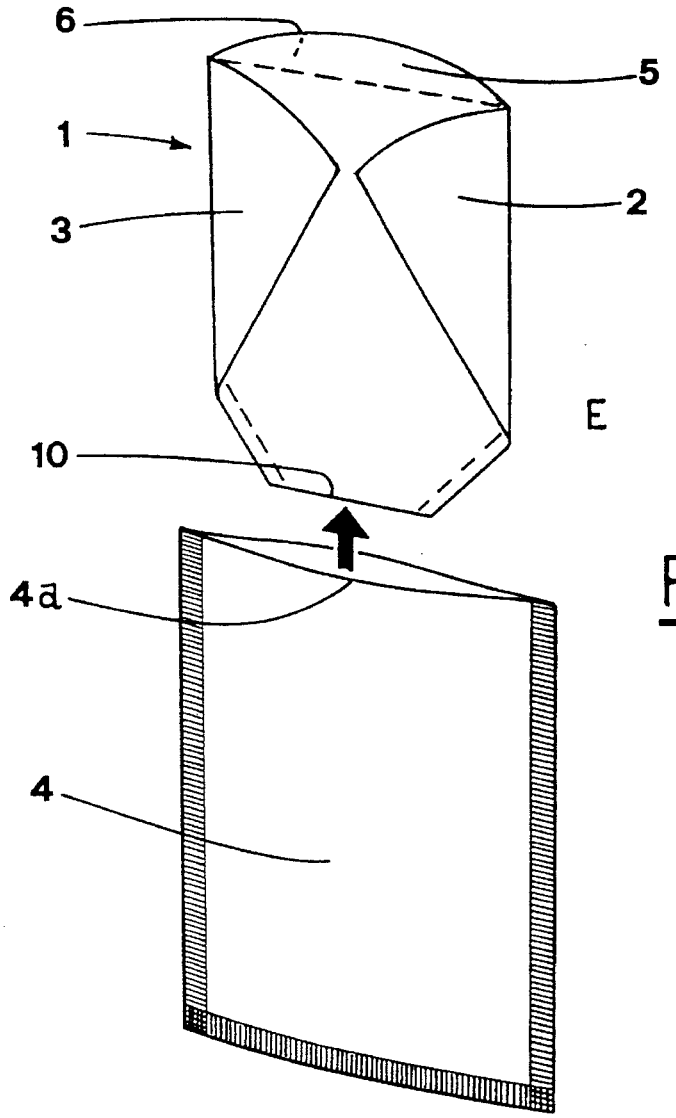
FIG. 1 shows a schematic view of a disposable filter bag according to a preferred embodiment of the present invention, in overfolded condition and just withdrawn from the containing cover, together with this cover.
Figure 2:
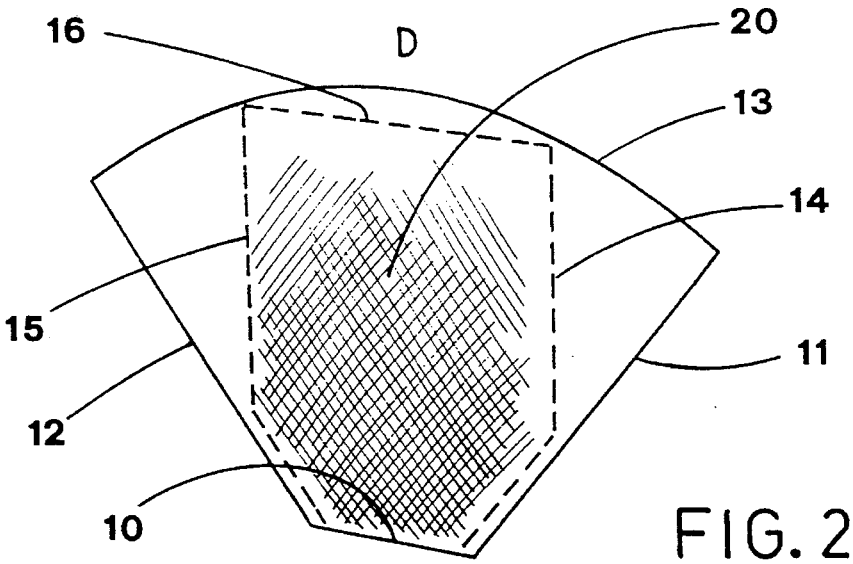
FIG. 2 shows the disposable filter bag of FIG. 1, once it has been unfolded but still flattened.
Figure 3:
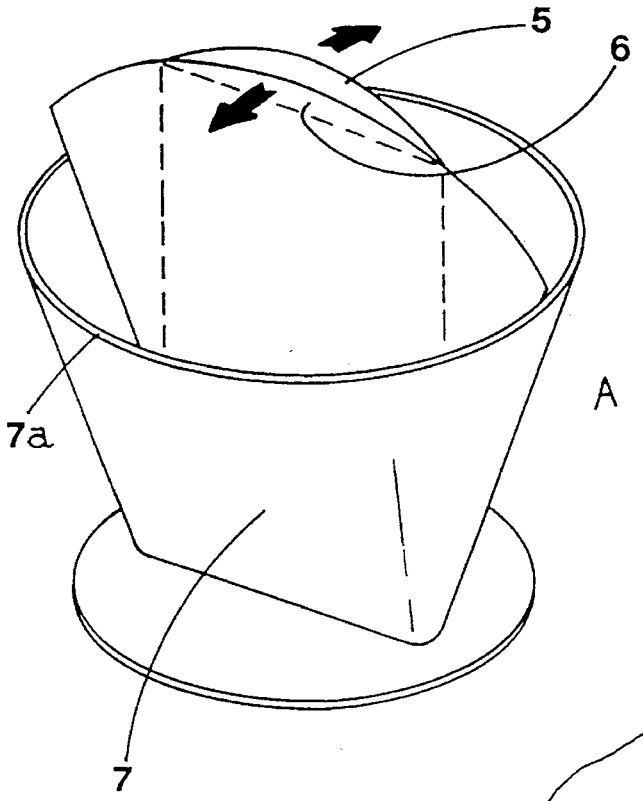
FIG. 3 shows the disposable filter bag of FIG. 1, just before being opened in the basket.
Figure 4:
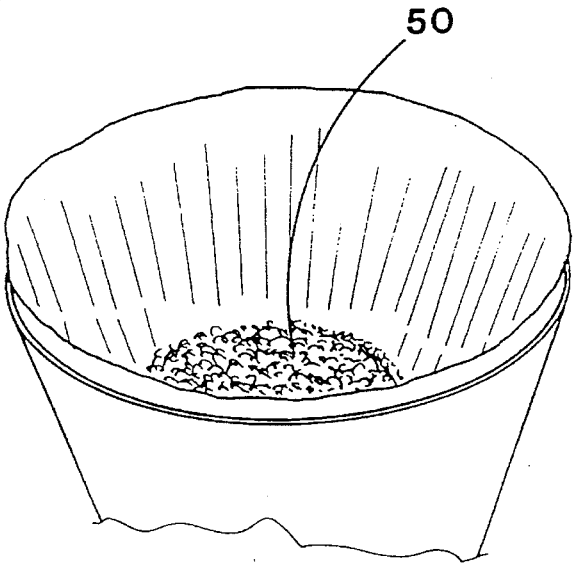
FIG. 4 shows the disposable filter bag of FIG. 1, fully opened inside the basket.

With reference to FIGS. 1 and 2, the preferred embodiment of a disposable filter bag for American coffee is described.

A water permeable paper material filter bag, is formed by two superimposed sheets of the said material, having the form of a truncated circular sector delimited by a lower horizontal edge 10 and straight side edges, respectively right 11 and left 12, and by an upper arched edge 13.

In correspondence with the side edges right 11 and left 12, the filter 1 has strong heat seam lines that permanently join the two sheets of paper along the side edges 11 and 12.

A nearly rectangular chamber 20 is delimited by the lower edge 10, two vertical weak heat seam lines, respectively right 14 and left 15, symmetrical with respect to the said lower end 10, and by a horizontal weak seam straight line 16, situated close to the upper edge 13.

The two vertical weak heat seam lines 14 and 15 also delimit, at both sides of the chamber 20, two wings, respectively a right wing 2 and a left wing 3, which can be folded inwards over the chamber 20.

The upper side 16 of the chamber 20 and the upper edge 13 of the filter delimit two upper strips, respectively a front strip 5 and a rear strip 6, each belonging to a respective sheet of paper material forming the filter 1.

The chamber 20 is filled with a proper batch of roasted and ground coffee 50 and the filter bag 1 is introduced, with the wings 2, 3 folded, into a cover 4.

When using the disposable filter bag 1, the steps E, in which the filter bag is removed from the cover, D, in which it is unfolded, and A, in which it is positioned and opened, are to be performed.

The above mentioned steps will be described in the following with reference to FIGS. 1 to 4.

Just before the step E, the filter 1 is housed in the cover 4, and can be removed therefrom through an opening made in the cover 4, e.g. along an upper edge 4*a*.

In the subsequent step D, the right wing 2 and left wing 3 are rotated about the axes defined by the respective right side 14 and left side 15 of the chamber 20, until the wings 2, 3 become coplanar with the chamber 20 and the filter bag is flat.

In the following step A, the filter 1 is introduced into a tapered basket 7, so that the strips 5, 6 extend beyond the upper rim 7*a* of the basket 7.

Then the strips 5, 6 are manually separated from each other, so that the weak heat seam lines, defining the upper side 16, left side 15 and right side 14 of the chamber 20, are peeled off, allowing the two sheets of the filter 1 to open and the same filter to assume the tapered basket shape.

The ground coffee 50, due to gravity force, settles on the bottom of the filter 1.

The above described disposable filter bag is simple and practical in use, since all the preparation operations are limited to opening and positioning the filter 1, therefore also avoiding the possible waste of ground coffee 50 that may fall outside the filter.

The sealed cover 4 is opened only immediately before use, assuring coffee freshness and fragrance.

The wings 2, 3 can be folded inwards, that allows to reduce the size of the cover 4, with remarkable advantages for transport and/or storing, and with a savings in the packaging material.

What is claimed is:

1. A disposable filter bag for preparation of a hot brewed beverage comprising two superimposed sheets of water permeable material having the form of a truncated circular sector joined to each other along a lower straight edge, right side and left side, and along an upper weak heat seam line which forms an upper side of a closed chamber filled, before sealing, with a premeasured batch of a vegetable substance, upper strips made in the same filter bag and delimited by the upper weak seam line and upper arched edge of said filter bag, the filter bag being manually opened by pulling the upper strips, the chamber of the filter bag being delimited by two vertical weak heat seam lines, a right vertical heat seam line and a left vertical heat seam line, each of which can be peeled off by manually pulling upon the upper strips, so that the chamber results in a roughly rectangular shape, the vertical weak heat seam lines also delimiting two wings, a right wing and a left wing, which can be folded inwardly over the chamber so that the shape of the filter bag when folded and packed is roughly rectangular.

* * * * *